US006467210B1

(12) United States Patent
Chang

(10) Patent No.: US 6,467,210 B1
(45) Date of Patent: Oct. 22, 2002

(54) VERSATILE PICTURE FRAME

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 09/716,268

(22) Filed: Nov. 21, 2000

(51) Int. Cl.[7] ..... A47G 1/06
(52) U.S. Cl. ..... 40/792; 40/732
(58) Field of Search ..... 40/792, 793, 794, 40/795, 732, 768

(56) References Cited

U.S. PATENT DOCUMENTS 398,953 A * 3/1889 East ..... 40/727
1,220,418 A * 3/1917 Hawkes ..... 40/737
1,692,999 A * 11/1928 Siegel ..... 40/732
3,953,933 A * 5/1976 Goldstein ..... 40/642.02
4,655,428 A * 4/1987 McCrea ..... 248/470
5,524,370 A * 6/1996 Roy ..... 40/748
6,253,473 B1 * 7/2001 Collins ..... 40/120

* cited by examiner

*Primary Examiner*—William L. Miller
(74) *Attorney, Agent, or Firm*—Browdy and Neimark, P.L.L.C.

(57) ABSTRACT

A picture frame comprises a main body, at least one elastic member, and a press member. The main body is provided with a picture slot to accommodate a picture to be displayed. The picture slot is provided with two retaining grooves for retaining the elastic member. The press member is disposed in the picture slot such that the picture is pressed against by the press member, and that one side of the press member is urged by the elastic member, and that other side of the press member is inserted into the groove. When the press member is pushed in the direction toward the elastic member, the other side of the press member is forced out of the groove in which it is retained. The press member is thus removed from the picture slot of the main body so as to facilitate the replacing of the picture.

15 Claims, 4 Drawing Sheets

VERSATILE PICTURE FRAME

FIELD OF THE INVENTION

The present invention relates generally to a picture frame, and more particularly to a versatile picture frame.

BACKGROUND OF THE INVENTION

The conventional picture frame is generally defective in design in that a picture to be displayed can not be put into the picture frame from the front side of the picture frame, and that the picture must be put into the picture frame from the back side of the picture frame. It is time-consuming and inconvenient to replace a picture held in the picture frame or to put a new picture into the picture frame from the back side of the picture frame. This is particularly true with a wall picture frame, which must be first removed from the wall. In addition, the back side of the conventional picture frame lacks a decorative effect. Moreover, the conventional picture frame is not compatible with vanity, cabinet, wall clock, jewelry box, etc.

SUMMARY OF THE INVENTION

The primary objective of the present invention is to provide a picture frame with means to enable a picture to be removed from or put into the picture frame from the front side of the picture frame.

It is another objective of the present invention to provide a picture frame with a back side having a decorative effect.

It is still another objective of the present invention to provide a versatile picture frame which can be used harmoniously along with other objects.

The picture frame of the present invention comprises a main body which is provided with a picture slot having a flat bottom to accommodate the back side of a picture. The picture slot is provided in the side walls thereof with two grooves opposite to each other. One of the two grooves is provided with an elastic member which is intended to provide a spring force directed toward the opposite groove. A press member is disposed in the picture slot to press the picture. The press member is hollow plate, transparent glass, or transparent acrylic plate. The side of the press member has a thickness slightly smaller than the width of the groove. The press member is disposed in the picture slot such that one side of the press member is pressed against by the elastic member, and that other side of the press member is inserted into the groove. As the press member is pushed in the direction toward the elastic member, the other side of the press member is let out of the groove, thereby enabling the press member to be removed from the main body to facilitate the replacing of the picture.

The foregoing objectives, features, functions, and advantages of the present invention will be more readily understood upon a thoughtful deliberation of the following detailed description of two preferred embodiments of the present invention with reference to the accompanying drawings.

DETAILED DESCRIPTION OF THE INVENTION

Figure 1:
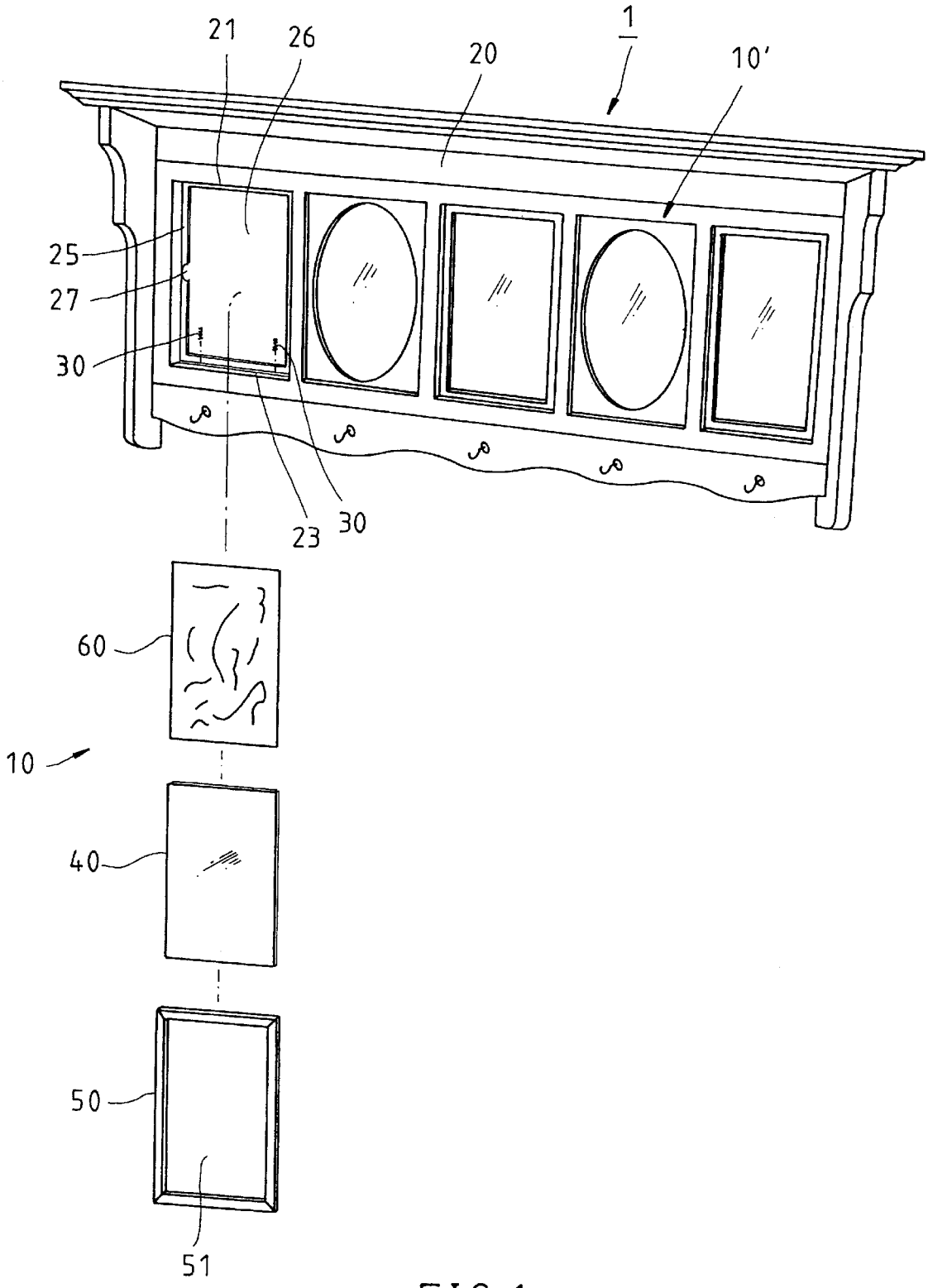
FIG. 1 shows an exploded view of a first preferred embodiment of the present invention.
Figure 2:
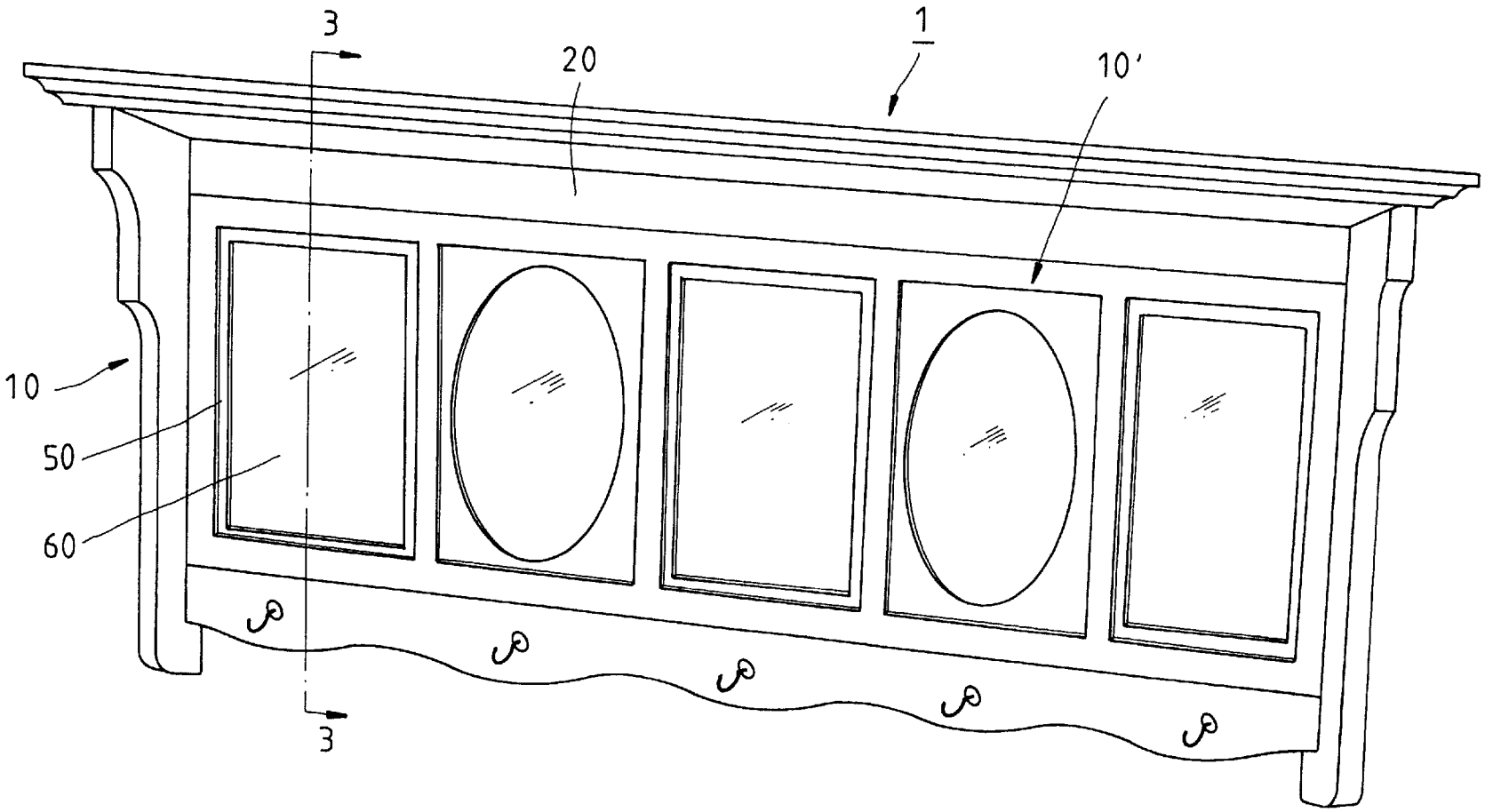
FIG. 2 shows a perspective view of the first preferred embodiment of the present invention in combination.
Figure 3:
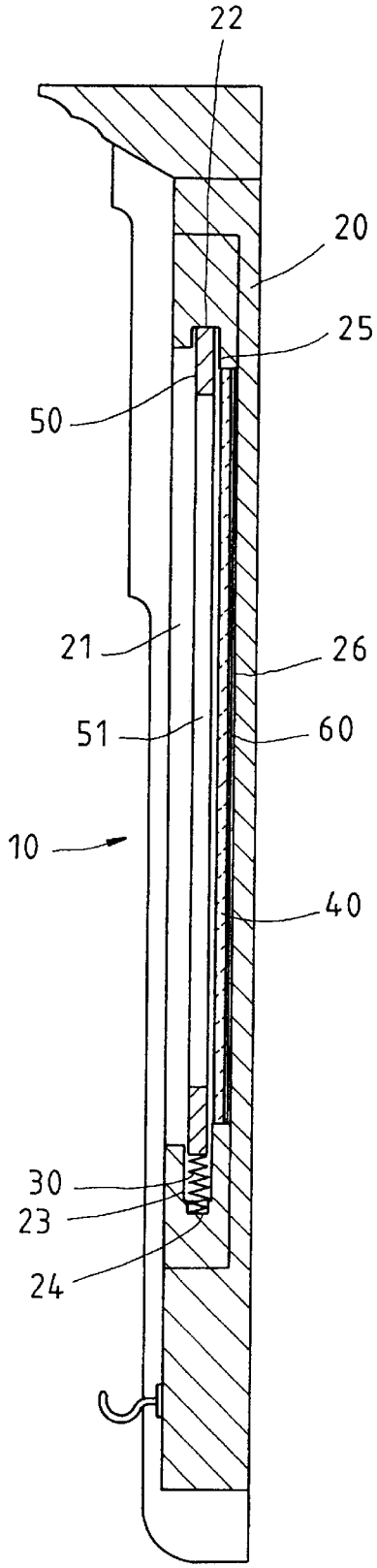
FIG. 3 shows a sectional view taken along the direction indicated by a line 3—3 as shown in FIG. 2.

As shown in FIGS. 1–3, a wall picture frame 1 is formed of a plurality of picture frames 10, with each comprising a main body 20, two elastic members 30, a transparent glass 40, and a press member 50.

The main body 20 is provided in the front side thereof with a picture slot 21 of a rectangular construction. The picture slot 21 has a flat bottom. The picture slot 21 is provided in the innermost edges of the upper and the lower walls thereof with an upper groove 22 and a lower groove 23. The grooves 22 and 23 have a length which is equal to the width of the picture slot 21. The lower groove 23 is provided in the bottom thereof with two insertion holes 24 symmetrical to each other. The picture slot 21 is further provided in the center of a bottom 25 thereof with an insertion slot 26 of a rectangular construction for receiving a picture. The insertion slot 26 is provided in the left edge with a retrieving cavity 27 of a semicircular construction.

The elastic members 30 are coil springs, which are disposed in the lower groove 23 of the picture slot 21 such that the bottom ends of the coil springs 30 are inserted into the insertion holes 24. The bottom ends of the coil springs 30 are fixed in the insertion holes 24 by an adhesive. When the coil springs 30 are not exerted on by an external force, the top ends of the coil springs 30 are level with the open top of the lower groove 23 and can be longitudinally compressed or expanded.

The transparent glass 40 is of a rectangular construction and is corresponding in length and width to the insertion slot 26 of the picture slot 21. The glass 40 is disposed in the insertion slot 26 to press the picture such that the outer side of the glass 40 is flush with the bottom 25 of the picture slot 21.

The press member 50 is a rectangular frame or a rectangular plate disposed in a rectangular hollow portion 51. The hollow portion 51 may be an oval, heart-shaped, or geometrically-formed picture frame 10' of the wall picture frame 1. The hollow portion 51 is smaller in area than the transparent glass 40. The press member 50 is corresponding in length and width to the picture slot 21. The thickness of the side of the press member 50 is slightly smaller than the width of the grooves 22 and 23. The press member 50 is disposed in the picture slot 21 to press against the glass 40 such that the bottom edge of the press member 50 is urged upwards by the elastic member 30 which is located in the lower groove 23, and that the bottom edge of the press member 50 is slightly sunk into the lower groove 23, and further that the top of the press member 50 is inserted into the upper groove 22. The press member 50 is thus located in the picture slot 21.

As the press member 50 is pushed downwards such that the top of the press member 50 is let out of the upper groove 22, the press member 50 is drawn out in such a manner that the top end is slightly slanted and faced outwards. As a result, the bottom side of the press member 50 is moved out of the lower groove 23. The press member 50 is thus removed from the picture slot 21, thereby enabling the glass 40 to be removed from the insertion slot 26. The insertion slot 26 is provided with the retrieving cavity 27 to facilitate the removal of the glass 40. Thereafter, the underside of a picture 60 is placed in the insertion slot 26. The glass 40 is then put back into the insertion slot 26 to press the picture 60. Finally, the press member 50 is slantingly put back into the picture slot 21 such that the inner side of the press member 50 comes in contact with the bottom 25, and that the press member 50 is forced by the elastic members 30 into the upper groove 22.

The press member may be provided in the hollow portion thereof with a transparent piece, such as glass or acrylic piece. The press member may be a transparent glass or transparent acrylic plate, which can be secured to the two opposite grooves by the method described above.

Figure 4:
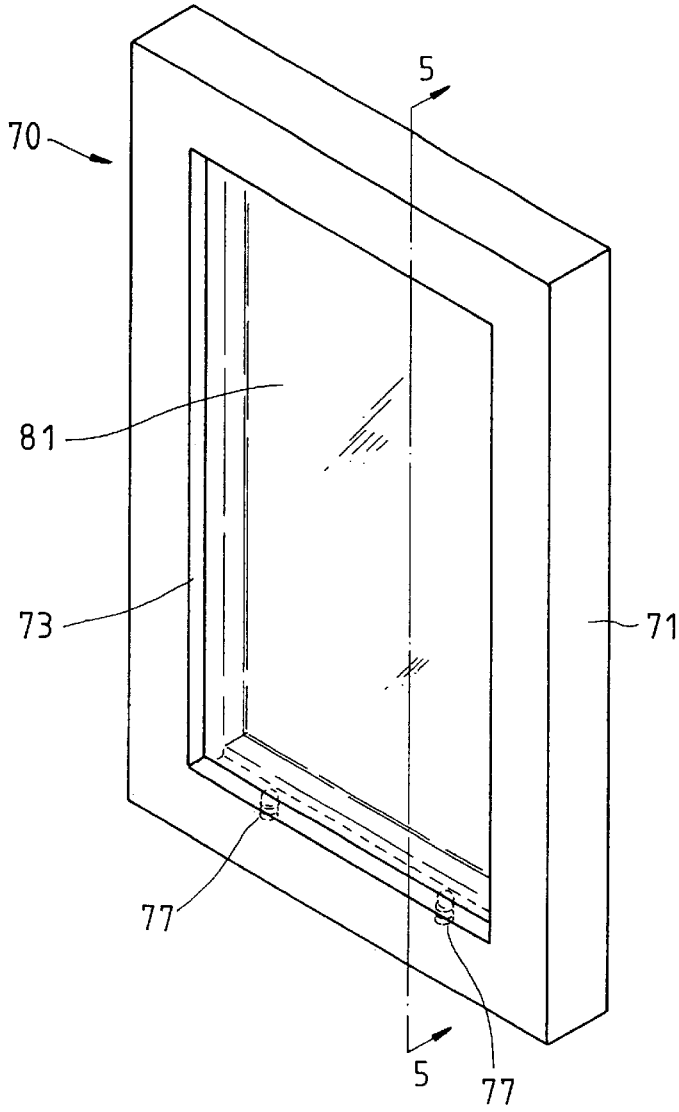
FIG. 4 shows a perspective view of a second preferred embodiment of the present invention in combination.
Figure 5:
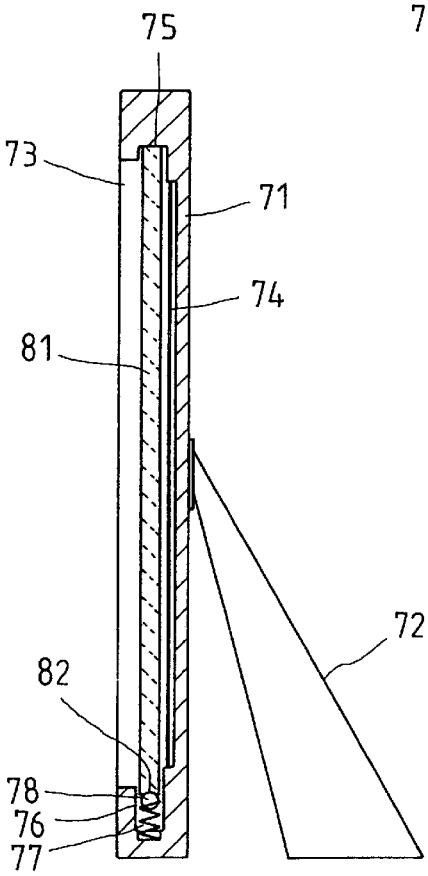
FIG. 5 shows a sectional view taken along the direction indicated by a line 5—5 as shown in FIG. 4.

As shown in FIGS. 4 and 5, a desktop picture frame 70 comprises a rectangular main body 71, which is supported on a desktop by a support frame 72 attached thereto. The main body 71 is provided in the front side with a rectangular picture slot 73 in which a picture 74 is disposed. The picture slot 73 is provided respectively in the upper wall and the lower wall with an upper groove 75 and a lower groove 76. Two elastic members 77 (coil springs) are attached at the bottom end to the lower groove 76 such that the top end of the springs 77 is provided with a ball 78 fastened therewith. A press member 81 (transparent glass) is disposed in the picture slot 73 and is provided in the bottom edge with a semicircular cavity 82 corresponding in location to the elastic members 77. The ball 78 is received in the cavity 82 such that the press member 81 is pushed upward by the ball 78, thereby causing the top edge of the press member 81 to be inserted into the upper groove 75. The picture 74 is pressed against by the press member 81 which is held securely in place in the picture slot 73.

The grooves of the picture slot may be located in the left and the right sides of the picture slot. The elastic members may be disposed in the grooves of any direction.

What is claimed is:

1. A picture frame comprising:

a main body provided with a picture slot for displaying a picture, said picture slot provided in an inner wall thereof with a first groove and a second groove opposite in location to each other;

at least one elastic member disposed in the first groove to provide a spring force directed toward the second groove;

a flat press member having front and back sides with a thickness which is smaller than a width of either the first groove or the second groove, said press member being corresponding in shape to said picture slot in which said press member is located to press against the picture to be displayed, said press member being disposed in said picture slot in such a way that a first edge of said press member is urged by said elastic member, and that a second edge of said press member is inserted into said second groove;

wherein the first groove is provided with at least one insertion hole; wherein said elastic member is disposed in the first groove such that a first end of said elastic member is retained in said insertion hole; and wherein the first end of said elastic member is fixed in said insertion hole by an adhesive.

2. The picture frame as defined in claim 1, wherein said press member is provided with a hollow portion through which the picture is visible; wherein said picture slot is provided with a transparent glass plate, and that said glass plate is pressed against by said press member.

3. The picture frame as defined in claim 2, wherein the first groove and second groove are respectively located in innermost edges of said inner wall of said picture slot; wherein said picture slot is provided at a bottom thereof with an insertion slot and a retrieving cavity in proximity of said insertion slot, said insertion slot being intended to accommodate the picture to be displayed; wherein said transparent glass plate is disposed in said insertion slot to press against the picture such that an outer side of said transparent glass plate is flush with said bottom of said picture slot.

4. The picture frame as defined in claim 1, wherein said press member is made from a transparent glass.

5. The picture frame as defined in claim 1, wherein said elastic member is a coil spring.

6. The picture frame as defined in claim 1, wherein said press member is provided with a semicircular cavity corresponding in location to said elastic member; wherein said elastic member is provided at a second end thereof with a ball fastened therewith such that said ball is received in said cavity.

7. The picture frame as defined in claim 1, wherein said picture slot is of a rectangular construction.

8. The picture frame as defined in claim 1, wherein said main body is provided with a support frame fastened therewith for supporting said main body uprightly on a surface.

9. The picture frame as defined in claim 8, wherein said press member is provided with a semicircular cavity corresponding in location to said elastic member; wherein said elastic member is provided at a second end thereof with a ball fastened therewith such that said ball is received in said cavity.

10. The picture frame as defined in claim 8, wherein said picture slot is of a rectangular construction.

11. A picture frame comprising:

a main body provided with a picture slot for displaying a picture, said picture slot provided in an inner wall thereof with a first groove and a second groove opposite in location to each other;

at least one elastic member disposed in the first groove to provide a spring force directed toward the second groove;

a flat press member having sides with a thickness which is smaller than a width of either the first groove or the second groove, said press member being corresponding in shape to said picture slot in which said press member is located to press against the picture to be displayed, said press member being disposed in said picture slot in such a way that a first edge of said press member is urged by said elastic member, and that a second edge of said press member is inserted into said second groove;

wherein said press member is provided with a hollow portion through which the picture is visible; wherein said picture slot is provided with a transparent glass plate disposed therein such that the picture is pressed against by said glass plate, and that said glass plate is pressed against by said press member; and wherein the first grove and second groove are respectively located in innermost edges of said inner wall of said picture slot; wherein said picture slot is provided at a bottom thereof with an insertion slot and a retrieving cavity in proximity of said insertion slot, said insertion slot being intended to accommodate the picture to be displayed; wherein said transparent glass plate is disposed in said insertion slot to press against the picture such that an outer side of said transparent glass plate is flush with said bottom of said picture slot.

12. The picture frame as defined in claim 11, wherein said press member is made from a transparent glass.

13. The picture frame as defined in claim 11, wherein said elastic member is a coil spring.

14. The picture frame as defined in claim 11, wherein the first groove is provided with at least one insertion hole; wherein said elastic member is disposed in the first groove such that a first end of said elastic member is retained in said insertion hole.

15. The picture frame as defined in claim 14, wherein the first end of said elastic member is fixed in said insertion hole by an adhesive.

* * * * *